US009914101B1

(12) United States Patent
Schrudder et al.

(10) Patent No.: US 9,914,101 B1
(45) Date of Patent: Mar. 13, 2018

(54) MUD MIXING BIT

(71) Applicants: Nathan Schrudder, Oceanside, CA (US); Victoria Schrudder, Oceanside, CA (US)

(72) Inventors: Nathan Schrudder, Oceanside, CA (US); Victoria Schrudder, Oceanside, CA (US)

( * ) Notice: Subject to any disclaimer, the term of this patent is extended or adjusted under 35 U.S.C. 154(b) by 157 days.

(21) Appl. No.: 14/731,748

(22) Filed: Jun. 5, 2015

(51) Int. Cl.
*B01F 7/00* (2006.01)

(52) U.S. Cl.
CPC ..... *B01F 7/00291* (2013.01); *B01F 7/00016* (2013.01); *B01F 2215/0047* (2013.01)

(58) Field of Classification Search
CPC ..... B01F 7/00291; B01F 7/00016; B01F 2215/0047
USPC ..... 366/129, 343, 248, 325.7, 325.8, 325.9
See application file for complete search history.

(56) References Cited

U.S. PATENT DOCUMENTS

| | | | | | |
|---|---|---|---|---|---|
| 308,901 | A * | 12/1884 | Kitchell | A23G 3/0215 | 366/325.7 |
| 1,746,892 | A * | 2/1930 | Guethler | A21C 1/1405 | 366/309 |
| 2,520,577 | A * | 8/1950 | Tooley | C03B 5/187 | 366/325.8 |
| 2,778,615 | A * | 1/1957 | Hahn | A47J 43/0711 | 416/135 |
| 2,905,453 | A | 9/1959 | Wise | | |
| 3,619,081 | A | 11/1971 | Gruska et al. | | |
| 5,382,092 | A | 1/1995 | Okamoto et al. | | |
| 5,403,091 | A | 4/1995 | Thomas | | |
| 5,417,493 | A | 5/1995 | Ericson | | |
| 5,688,048 | A * | 11/1997 | Duckworth | B01F 7/32 | 366/343 |
| 5,865,539 | A * | 2/1999 | Rogers | B01F 7/32 | 366/129 |
| 6,863,430 | B2 | 3/2005 | Berube | | |
| 7,131,765 | B2 | 11/2006 | Backhaus | | |
| 7,887,230 | B2 | 2/2011 | Rosso et al. | | |
| D637,871 | S | 5/2011 | Frank | | |

FOREIGN PATENT DOCUMENTS

WO WO 2008018257 A1 * 2/2008 ..... A47J 43/0711

OTHER PUBLICATIONS http://www.toolbarn.com/kraft-dc305.html (Feb. 25, 2012).
http://www.toolbarn.com/cox-3m1201.html (Feb. 24, 2012).
http://www.toolbarn.com/kraft-dc308.html (Oct. 26, 2011).
http://www.toolbarn.com/marshalltown-rm771.html (Feb. 24, 2012).
http://www.toolbarn.com/kraft-dc362.html (Oct. 26, 2011).
http://3.bp.blogspot.com/__2Vblc1t1K3M/TJE_QCqf-1l/AAAAAAAAAvg/anW5RtMcwJQ/s400/WhWhFr6.jpg, Date unknown.

* cited by examiner

*Primary Examiner* — Walter D Griffin
*Assistant Examiner* — Marc C Howell
(74) *Attorney, Agent, or Firm* — Robert C. Montgomery; Montgomery Patent Design

(57) ABSTRACT

A mixing bit having an elongated shaft configured to fit into a chuck of a drill at a first end also has a second end is provided with a blade assembly having a plurality of specifically shaped and equally-spaced blades. The blades extend perpendicularly from the shaft and then converge onto the shaft at a distal end of the second end. The bit is provided with a rounded spinner feature enabling smooth sliding of the device across a floor portion of a container during mixing.

18 Claims, 2 Drawing Sheets

MUD MIXING BIT

RELATED APPLICATIONS

There are no current related applications.

FIELD OF THE INVENTION

The present invention relates to a mixing bit used in conjunction with a portable drill to agitate and mix a volume of mud within a container.

BACKGROUND OF THE INVENTION

Drywall is perhaps the most common interior wall surface used in the world today. It is easy to work with, low-cost, and looks great when finished. The seams between pieces of drywall along with fastening nails and screws are covered in multiple layers of drywall compound to provide a smooth appearance. For large jobs this compound is mixed in a large container, and transferred to smaller hand-held "mud" pans for subsequent direct application to the wall surface. However, there are times when the compound may require additional mixing in the mud pan itself. Additionally, there are also times when only a small amount of compound is needed, and the worker may attempt to mix the compound directly in the mud pan with often unsatisfactory results. Accordingly, there exists a need for a means by which drywall compound can be mixed in a mud pan or similar small container in a satisfactory manner. The development of the present invention fulfills this need.

SUMMARY OF THE INVENTION

It is therefore an object of the present invention to provide a bit particularly suited for mixing drywall mud, including a central shaft having a first end and a second end, and a blade arrangement affixed to the second end, including a plurality of vanes each having a first section extending perpendicularly from an intermediate position of the central shaft and having a second portion converging adjacent to a terminus of the central shaft. In a preferred embodiment, the vanes form a symmetric arrangement about the central shaft.

Another object of the present invention is to provide that the central shaft has a hexagonal shaft, particularly suited for connection to a driving device.

A further object of the present invention is to provide the blade arrangement configured to enable use within a tapering slope of an interior of a conventional mud pan. Such an embodiment would have the vanes' first section to be generally "V"-shaped and the second section to be generally "L"-shaped.

Yet another object of the present invention is to provide where the plurality of vanes are each spaced at (90°) intervals about a perimeter of the central shaft.

Yet another object of the present invention provides for a spinner feature to be located at the terminus of the central shaft second end to enable a relatively friction-less rotation of the bit as it contacts the bottom of the mud pan. In a preferred embodiment, the spinner feature has a diameter coextensive with a maximum cross-sectional length of said central shaft.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
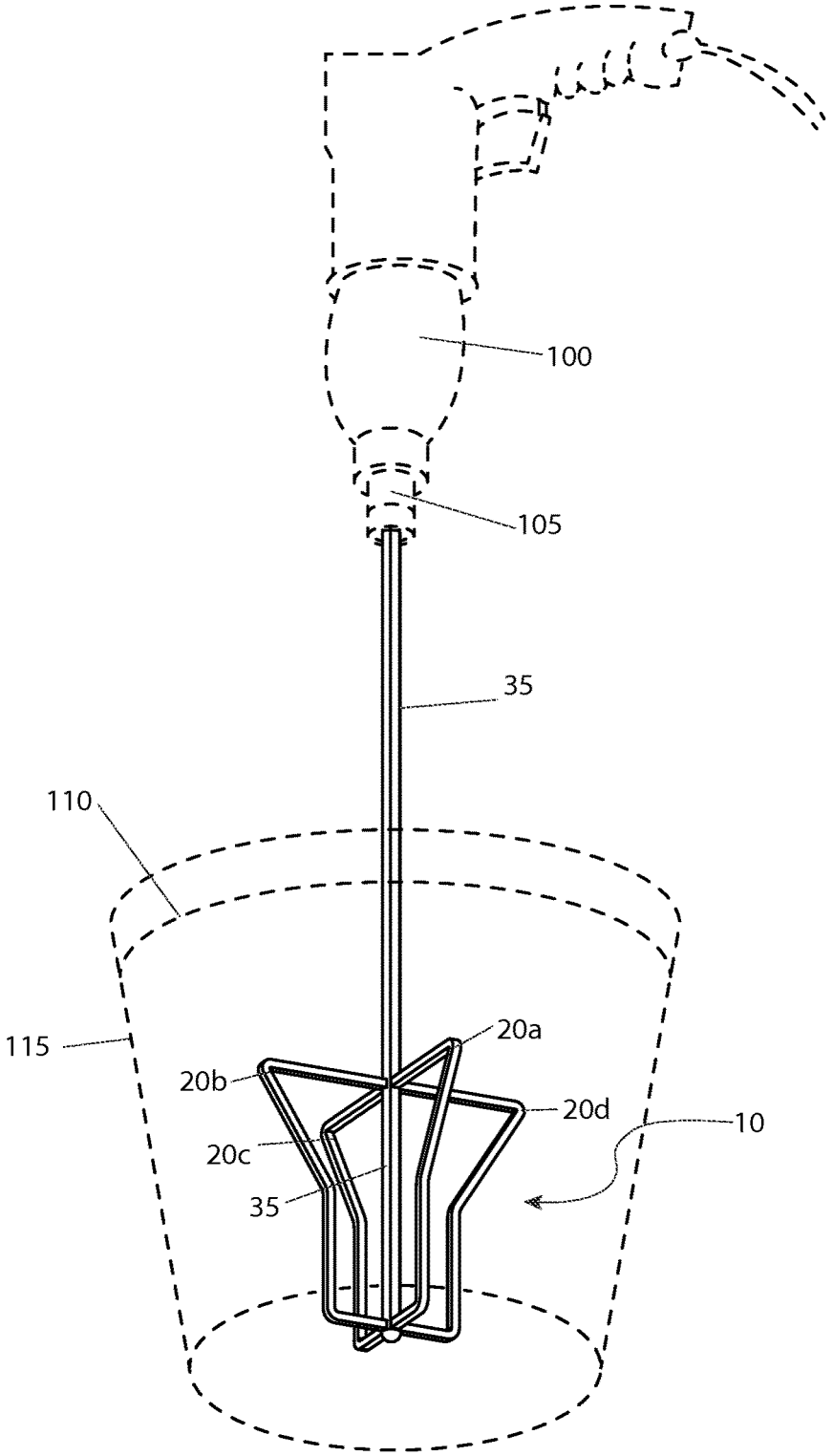
FIG. 1 is an environmental perspective view of a mud mixing bit 10, according to a preferred embodiment of the present invention.

10 mud mixing bit
20*a* first blade
20*b* second blade
20*c* third blade
20*d* fourth blade
25 upper section
27 lower section
30 spinner feature
35 rod
100 rotary power tool
105 chuck
110 liquid
115 container

DETAILED DESCRIPTION OF THE PREFERRED EMBODIMENT

Figure 2:
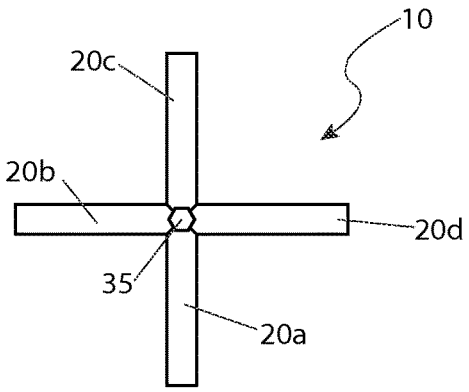
FIG. 2 is a top view of the mud mixing bit 10, according to a preferred embodiment of the present invention, and, FIG. 3 is a front view of the mud mixing bit 10, according to a preferred embodiment of the present invention.
Figure 3:
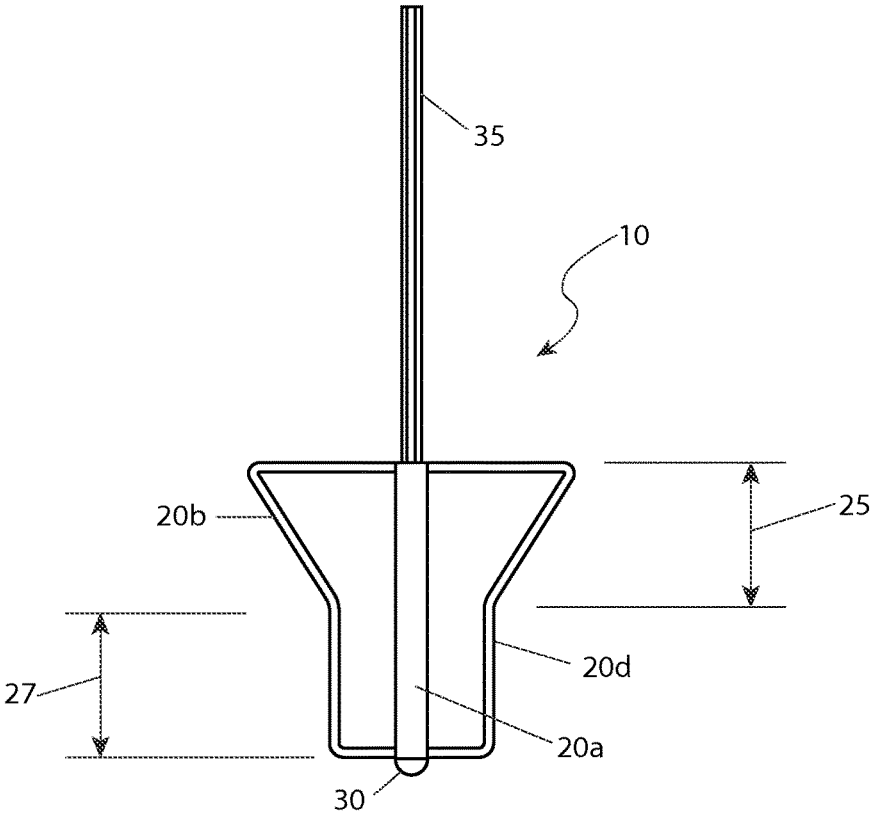

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a mud mixing bit (herein described as the "device") 10, which provides a mixing tool adapted to provide a rotary driven means for rapidly mixing or agitating various viscous liquids 110 such as drywall joint compound, or similar substances.

Referring now to FIG. 1, an environmental perspective view of the device 10, according to the preferred embodiment of the present invention, is disclosed. The device 10 comprises a plurality of mixing blades 20*a*, 20*b*, 20*c*, 20*d*, a central vertical rod 35, and a spinner feature 30. The blades 20*a*, 20*b*, 20*c*, 20*d* are arranged in an equally-spaced radial manner about, and permanently affixed thereto the rod 35.

The portions 20*a*, 20*b*, 20*c*, 20*d*, 30, 35 of the device 10 define an assembly having rigid steel portions which are permanently affixed to each other via a welding process or other equivalent metal joining process.

In a preferred embodiment, the blades 20*a*, 20*b*, 20*c*, 20*d* form an assembly approximately seven and fifteen-sixteenths inches ($7\frac{5}{16}$ in.) in height and six and thirteen-sixteenths inches ($6\frac{13}{16}$ in.) in width. The preferred embodiment includes a rod 35 which is twenty-four inches (24 in.)

in length and preferably made using seven-sixteenths of an inch (7/16 in.) hexagonal bar stock. However, it is understood that the device 10 may be provided in various overall sizes suitable to particular construction applications, and based upon a user's preference, and as such should not be interpreted as a limitation of scope.

As seen here, the rod 35 extends upwardly from the blade portions 20*a*, 20*b*, 20*c*, 20*d*, to enable engagement with a chuck portion 105 of a rotary power tool 100, such as a drill motor, which in turn provides a rotating force to the device 10. The rod 35 is to be of sufficient length so as to enable mixing of a large volume of liquid 110 within various containers 115 such as a five gallon (5 gal) bucket (shown here), a standard "mud pan", or the like.

The device 10 is envisioned to be capable of thoroughly mixing a large quantity of a viscous liquid 110 in less than a minute.

Referring now to FIG. 2, a top view of the device 10 illustrating a preferred embodiment is shown here which provides four (4) blades 20*a*, 20*b*, 20*c*, 20*d* being spaced at ninety degree (90°) increments around the rod 35; however, it is understood the actual number of blades 20*a*, 20*b*, 20*c*, 20*d* may vary based upon a particular application of the device 10, or a user's preference, and as such should not be interpreted as a limiting factor.

Referring now to FIG. 3, a front view of the device 10, according to the preferred embodiment of the present invention, is disclosed. Each blade 20*a*, 20*b*, 20*c*, 20*d* forms a generally "U"-shaped appendage having terminal end portions being affixed to a respective side surface of the vertical rod 35. The blades 20*a*, 20*b*, 20*c*, 20*d* are tapered along their outer surface so as to match an angled profile of a conventional "mud pan" used in the dry wall construction business.

Each blade 20*a*, 20*b*, 20*c*, 20*d* is positioned so as to terminate coincidentally at a bottom end portion of the rod 35. In a preferred embodiment, each blade 20*a*, 20*b*, 20*c*, 20*d* is approximately one-half of an inch (½ in.) in width, one-eighth of an inch (½ in.) in thickness, and seven and five-sixteenths inches (7 5/16 in.) in height.

Furthermore, each blade 20*a*, 20*b*, 20*c*, 20*d* includes an upper section 25 and a lower section 27 having approximately equal in height. When viewed from a side perspective, the upper section 25 forms a "V"-shaped portion which protrudes perpendicularly outward from the rod 35 approximately three and one-half inches (3½ in.) before angling downwardly and inwardly towards the rod 35 at an approximate included angle of sixty degrees (60°) before meeting the lower section 27. The lower section 27 forms an "L"-shaped portion which protrudes vertically downward from the upper section 25 subsequently forming a right angle whereby it is directed toward, and affixed to the rod 35. When viewed from the side, as seen here, each blade 20*a*, 20*b*, 20*c*, 20*d* presents a profile resembling an inverted half-bell shape.

The device 10 also includes an integral spinner feature 30 which comprises a hemispherically-shaped protrusion located upon a bottom portion of the rod 35, being designed to reduce friction as the device 10 comes in contact with a bottom surface of the container 115. The spinner feature 30 has a diameter approximately equal to that of the cross-sectional size of the rod 35. The spinner feature 30 allows the device 10 to glide smoothly along a floor portion of a container 115 or dry wall "mud pan" while in use.

It is envisioned that other styles and configurations of the present invention can be easily incorporated into the teachings of the present invention, and only one (1) particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: procuring a model of the device 10 having a desired overall size and desired number of blades 20*a*, 20*b*, 20*c*, 20*d*; inserting the hexagonal top end of the rod 35 into a chuck portion 105 of a rotary power tool 100, such as a drill motor; tightening the chuck 105 to secure the device 10 to the rotary power tool 100; submerging the blade portions 20*a*, 20*b*, 20*c*, 20*d* of the device 10 into the container 115 and below the surface of the contained viscous liquid 110; rotating the device 10 by actuating the rotary power tool 100 in a normal manner; allowing the device 10 to agitate and mix the liquid 110 until obtaining a desired consistency of the liquid 110; deactivating the rotary power tool 100; retracting the device 10 from the container 115; utilizing the liquid 110 to perform a construction task; remixing the liquid 110 during the construction project as needed using the device 10 and the rotary power tool 100; removing the device 10 from the chuck portion 105 of the rotary power tool 100 in a normal manner; cleaning and storing the device 10 until needed again; and, benefiting from the reduced effort and timely mixing of a viscous liquid 110 afforded a user of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A mixing bit comprising:

a central shaft, having a first end and a second end, wherein at least said first end has a polygonal cross sectional shape; and, a blade arrangement disposed on said second end, comprising a plurality of vanes, wherein each vane of said plurality of vanes comprises:

a first member comprising a first member-first end connected to an intermediate location of said central shaft and an opposing first member-second end, said first member extending perpendicularly outward from said central shaft;

a second member comprising a second member-first end connected to said first member-second end and an opposing second member-second end, said second member extending downward and depending inward from said first member;

a third member comprising a third member-first end connected to said second member-second end and an opposing third member-second end, said third member extending downward from said second member and angularly offset from said second member; and a fourth member comprising a fourth member-first end connected to said third member-second end and an opposing fourth member-second end connecting adjacent to a terminus of said central shaft, said fourth member extending perpendicularly inward from said third member; and wherein:

each vane of said plurality of vanes comprises an overall length, measured along an axis parallel to said central shaft;

said second member forms a first half of said overall length of said vane; and said third member forms a second half of said overall length of said vane.

2. The mixing bit recited in claim 1, wherein said polygonal cross sectional shape is hexagonal.

3. The mixing bit recited in claim 1, wherein said third member of said each vane is substantially parallel to said central shaft.

4. The mixing bit recited in claim 1, wherein said blade arrangement is configured to match a tapered profile of an interior of a mud pan.

5. The mixing bit recited in claim 1, wherein said plurality of vanes are each spaced at ninety-degree intervals about a perimeter of said central shaft.

6. The mixing bit recited in claim 5, wherein said first member and said second member of said each vane define a generally V-shaped first section of said each vane, and wherein said third member and said fourth member of said each vane define a generally L-shaped second section of said each vane.

7. The mixing bit recited in claim 6, wherein said third member is oriented parallel with said central shaft, and wherein said fourth member is oriented perpendicular to said terminus of said central shaft.

8. The mixing bit recited in claim 7, wherein said blade arrangement is configured to match a tapered profile of an interior of a mud pan.

9. A mixing bit, comprising:

a central shaft, having a first end and a second end, wherein at least said first end has a polygonal cross sectional shape;

a blade arrangement disposed on said second end, comprising a plurality of vanes, wherein each vane of said plurality of vanes comprises:

a first member comprising a first member-first end connected to an intermediate location of said central shaft and an opposing first member-second end, said first member extending perpendicularly outward from said central shaft;

a second member comprising a second member-first end connected to said first member-second end and an opposing second member-second end, said second member extending downward and depending inward from said first member;

a third member comprising a third member-first end connected to said second member-second end and an opposing third member-second end, said third member extending downward from said second member and angularly offset from said second member; and a fourth member comprising a fourth member-first end connected to said third member-second end and an opposing fourth member-second end connecting adjacent to a terminus of said central shaft, said fourth member extending perpendicularly inward from said third member; and a spinner feature affixed to said terminus of said central shaft; and wherein:

each vane of said plurality of vanes comprises an overall length, measured along an axis parallel to said central shaft;

said second member forms a first half of said overall length of said vane; and said third member forms a second half of said overall length of said vane.

10. The mixing bit recited in claim 9, wherein said polygonal cross sectional shape is hexagonal.

11. The mixing bit recited in claim 9, wherein said third member of said each vane is substantially parallel to said central shaft.

12. The mixing bit recited in claim 9, wherein said blade arrangement is configured to match a tapered profile of an interior of a mud pan.

13. The mixing bit recited in claim 9, wherein said plurality of vanes are each spaced at ninety-degree intervals about a perimeter of said central shaft.

14. The mixing bit recited in claim 13, wherein said first member and said second member of said each vane defines a generally V-shaped first section of said each vane, and wherein said third member and said fourth member of said each vane define a generally L-shaped second section of said each vane.

15. The mixing bit recited in claim 14, wherein said third member is oriented parallel with said central shaft, and wherein said fourth member is oriented perpendicular to said terminus of said central shaft.

16. The mixing bit recited in claim 15, wherein said blade arrangement is configured to match a tapered profile of an interior of a mud pan.

17. The mixing bit recited in claim 9, wherein said spinner feature comprises a hemispherical outer surface opposite said central shaft.

18. The mixing bit recited in claim 17, wherein said spinner feature has a diameter coextensive with a maximum cross-sectional length of said central shaft.

* * * * *